United States Patent [19]

Wild

[11] Patent Number: 4,473,987

[45] Date of Patent: Oct. 2, 1984

[54] DOUBLE CASE LOADING BOTTLE PACKER GRID ASSEMBLY

[76] Inventor: Anton J. Wild, 182 Blvd., Kenilworth, N.J. 07033

[21] Appl. No.: 398,454

[22] Filed: Jul. 14, 1982

[51] Int. Cl.[3] ..... B65B 21/14; B65B 39/00

[52] U.S. Cl. ..... 53/247; 53/202; 53/255; 53/257; 53/539

[58] Field of Search ..... 53/202, 247, 255, 257, 53/261, 262, 263, 443, 448, 537, 539, 543

[56] References Cited

U.S. PATENT DOCUMENTS

| | | | |
|---|---|---|---|
| 3,031,820 | 5/1962 | Schulze et al. | 222/182 |
| 3,271,928 | 9/1966 | Wild | 53/248 |
| 3,325,967 | 6/1967 | Wild | 53/262 |
| 3,479,791 | 11/1969 | Wild | 53/497 |
| 3,561,189 | 2/1971 | Raudat | 53/248 X |
| 3,788,034 | 1/1974 | Hartness et al. | 53/248 |
| 3,852,936 | 12/1974 | Wilson et al. | 53/443 |
| 3,911,647 | 10/1975 | Hartness et al. | 53/248 |
| 3,922,836 | 12/1975 | McGill | 53/248 |
| 3,948,018 | 4/1976 | Rowekamp | 53/539 X |
| 4,033,095 | 7/1977 | Wild | 53/248 |
| 4,170,096 | 10/1979 | Wild | 53/248 |

*Primary Examiner*—John Sipos
*Assistant Examiner*—Steven P. Weihrouch
*Attorney, Agent, or Firm*—Sperry, Zoda & Kane

[57] ABSTRACT

A bottle packer grid assembly is disclosed which is capable of packing two cases simultaneously wherein the construction provides the capability for each individual single case grid section to be separately removable from the surrounding support structure. The configuration of the packer grid basically includes four transverse members and preferably five longitudinally extending members which divide the bottles to be packed into grids of variable numbers of rows and columns, the most common being 4×6. Preferably a dead plate support is positioned to hold one bottle in between the two cases being loaded in order to better maintain alignment with the cases positioned therebelow. The cooperation of a plurality of pin means with the transversely extending members which define apertures therein for receiving the pin means allows two arrays of 4×6 with a dead bottle position therebetween and yet allow upon removal of certain pins the easy maintenance of a specific bottle receiving cell. Also, maintenance of the guide means located along the longitudinally extending members is facilitated since each grid is itself individually removable from the main structure. A retaining bar is preferably included in which is affixed the two central pin sections to maintain a specific spaced relation between each of the packer grids and thereby maintain proper orientation for a dead bottle position located therebetween. Each of the pins extending through the side rails is maintained within a slot defined therein which is longitudinally elongated to allow longitudinal adjustment of the grids with respect to one another and with respect to the surrounding environmental structure.

15 Claims, 6 Drawing Figures

DOUBLE CASE LOADING BOTTLE PACKER GRID ASSEMBLY

BACKGROUND OF THE INVENTION

1. Field of the Invention

This invention relates to equipment used for the filling of cartons or cases with bottles and/or cans. The invention is particularly adapted for usage of the packer grid disclosed herein in combination with a control head wherein the control head carries the article to a position above the packer grid for release therethrough. The packer grid then orients the bottles and/or cans into the array of the case positioned therebelow for receiving thereof.

Devices in the prior art have been of many different configurations, however, they have basically been unduly complicated in construction requiring the use of many different members with the result that they are expensive to produce and maintain. Difficulties are also encountered due to the manner in which the articles are fed to the control head with the result that the articles may jam or be displaced. With such rough usage as this type of equipment experiences, damage to the grid is commonplace. With prior art devices any such damage requires disassembly of the entire bottle packing grid station. The present invention has the advantage over those designs since each of the individual grids of the double case packer is individually removable to allow maintenance of the guide members or the channel dividers in a simple and efficient manner.

2. Description of the Prior Art

Prior art devices utilizing this type of design are such as shown in U.S. Pat. No. 3,325,967 patented June 20, 1967 to A. J. Wild for equipment depositing articles and receptacles. The present invention is an advancement over the design of this above patent since the present invention utilizes individually removable grid sections. In this patent and in many of the designs currently being used, it is necessary to completely disassemble the control head and packer grid station to repair an element thereof. The present design on the other hand, is usable with a variety of different types of control heads and provides an easy manner for replacing elements of a packer grid especially usable with grids utilized for double case packing.

SUMMARY OF THE INVENTION

This invention discloses a double case loading bottle packer grid assembly particularly usable with individually removable grid sections. Side rails extend longitudinally along each side of the path of the movement of the bottles and are fixedly secured to the surrounding environmental structure, such as the assembly of the bottle conveyor line. Each of the side rails preferably defines a central slot extending laterally therethrough. The side rail further includes a front slot and a rear slot area extending laterally therethrough with the rear slot being behind the central slot and the front slot means being in front of the central slot.

The first grid section is positioned between the rails adjacent to the first front slot means and the front section of the central slot which is referred to as the first rear slot section. This first grid section includes a front transverse member extending laterally between the first front slot in each of the side rail means. Preferably the transverse member includes a front wedge means secured thereto to add structural strength to the definition of a lateral hole means extending therethrough. This lateral hole means is preferably adjacent to and registered with the first front slot means in the side rail to provide a manner for holding this end of the first grid section in place. Similarly, a transverse member extends across the rear area of the grid section between the first rear slot sections. Similarly, a first rear wedge is preferably located near the rear section of the first grid means to provide structural strength to a lateral hole means defined therein. This hole means is preferably aligned with the front section of the central slot means.

A plurality of guide members are affixed with respect to the longitudinally extending members to thereby define a plurality of bottle receiving cells in the first grid means. The cells are each individually defined to form a plurality of rows extending along the adjacent longitudinal members.

In order to maintain the first grid section in place a first front pin means is selectively capable of being positioned extending through the front slot means into the front lateral hole means to thereby maintain the first front transverse member in position between the side rails. Similarly, a first rear pin means is selectively positionable extending through the first rear slot section into the first rear lateral hole means to thereby maintain the first rear transverse member and thereby the entire first grid section in position between the side rails. To add structural strength a longitudinal support member is preferably fixedly secured with respect to the first front transverse member and the first rear transverse member to thereby fixedly retain the geometric orientation of the first grid section in its entirety.

A second grid section is spatially disposed rearwardly from the first grid section and is basically similar in construction. This second grid section includes a front transverse member defining a front lateral hole means therein and preferably includes a wedge means to facilitate structural strength of this front lateral hole means. Similarly, a rear transverse member is included at the rearmost portion of the grid means and a rear lateral hole means is defined within preferably a wedge means of the transverse member.

A plurality of second longitudinal members extends between the front transverse member and the rear transverse member being generally parallel with respect to the rail means and with respect to one another to thereby define the rows for receiving bottles into the second grid means. Also, a plurality of second guide members are affixed with respect to each of the second longitudinal members to thereby define a plurality of second bottle receiving cells along each row defined between adjacent longitudinal members.

In order to maintain a second grid in a fixed configuration with respect to the side rails a second front pin means is selectively capable of being positioned extending through the second front slot section into the second front lateral hole means to thereby maintain the second transverse member in position between side rails. Similarly, a second rear pin means is selectively positionable extending through the second rear slot into the second rear lateral hole to maintain the second rear transverse member and the entire second grid section in place. Similarly, a longitudinal support member associated with the second grid means is fixedly secured to the second transverse member in both the rear and front areas to thereby fixedly maintain orientation of the second grid section.

The double case loading bottle packer grid assembly also includes a dead plate support which is preferably fixedly secured to said second front transverse member. The dead plate support is thereby positioned above the first rear transverse member and the second front transverse member along each of the rows. In this manner the dead plate support will be located between the first grid section and the second grid section above the rearmost area of the first grid section and the foremost area of the second grid section. In this manner it will retain a single bottle thereabove during pace packing which is referred to as a dead bottle. Upon the next cycle the bottle will be moved to the rearmost location in the second grid means and be packed in the normal fashion. The dead plate support provides a support for the dead bottle. The dead bottle is preferable in order to maintain the spaced relations between the first and second grid means during packing of double cases. The central slot as well as the first front slot and the second rear slot are all preferably elongated such that selective movement of the pins therein will allow longitudinal adjustment of the position or longitudinal movement in general of the grid means of the present invention as desired or required. In order to maintain the proper spacing of the first and second grid means with respect to one another, it is preferable to include a retaining bar extending longitudinally along the outer side of the central slot means. This retaining bar is fixedly secured to the first rear pin means and the second front pin means to thereby maintain a predetermined spaced relation between the pins and hence a predetermined spaced relationship between the first grid section and the second grid section. In this manner the proper distance for the dead plate support will be maintained between grid sections.

Preferably the first rear transverse member and the second front transverse member will each include resiliently flexible inserts positioned therein. These inserts are preferably adjacent to each row of the bottle receiving cells to thereby minimize bottle damage during downward movement of the bottles through the packer grid.

It is an object of the present invention to provide a double case loading bottle and/or can packer grid assembly which includes individually removable case grid sections.

It is an object of the present invention to provide a double case loading bottle packer grid assembly which includes a dead plate support for supporting a dead bottle between the cases during packing.

It is an object of the present invention to provide a double case loading bottle packer grid assembly which minimizes maintenance costs thereof.

It is an object of the present invention to provide a double case loading bottle packer grid assembly which allows simple and easy replacement of individual elements of each removable grid.

It is an object of the present invention to provide a double case loading bottle packer grid assembly which is usable with many different types of control heads which deliver the bottles to the position to be packed.

It is an object of the present invention to provide a double case loading bottle packer grid assembly which can be removed merely by withdrawing a plurality of pin members.

It is an object of the present invention to provide a double case loading bottle packer grid assembly which minimizes maintenance costs.

It is an object of the present invention to provide a double case loading bottle packer grid assembly which allows longitudinal adjustment of the pair of grids.

It is an object of the present invention to provide a double case loading bottle packer grid assembly which maintains a constant spatial relationship between each of the two case grids to maintain the required dead bottle spacing.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

The present invention provides a bottle packer grid designed specifically for packing two cases of bottles simultaneously when received from a control head and divider system located thereabove. The design is of the dead bottle type wherein each row one bottle located between the cases is maintained in the upper position and is not packed therebelow. This bottle is then later moved downwardly into the second case for standard packing. The grid assembly for packing each case is individually removable from one another as well as each grid being itself removable with respect to the surrounding environmental structure of the bottle packing station.

Figure 1:
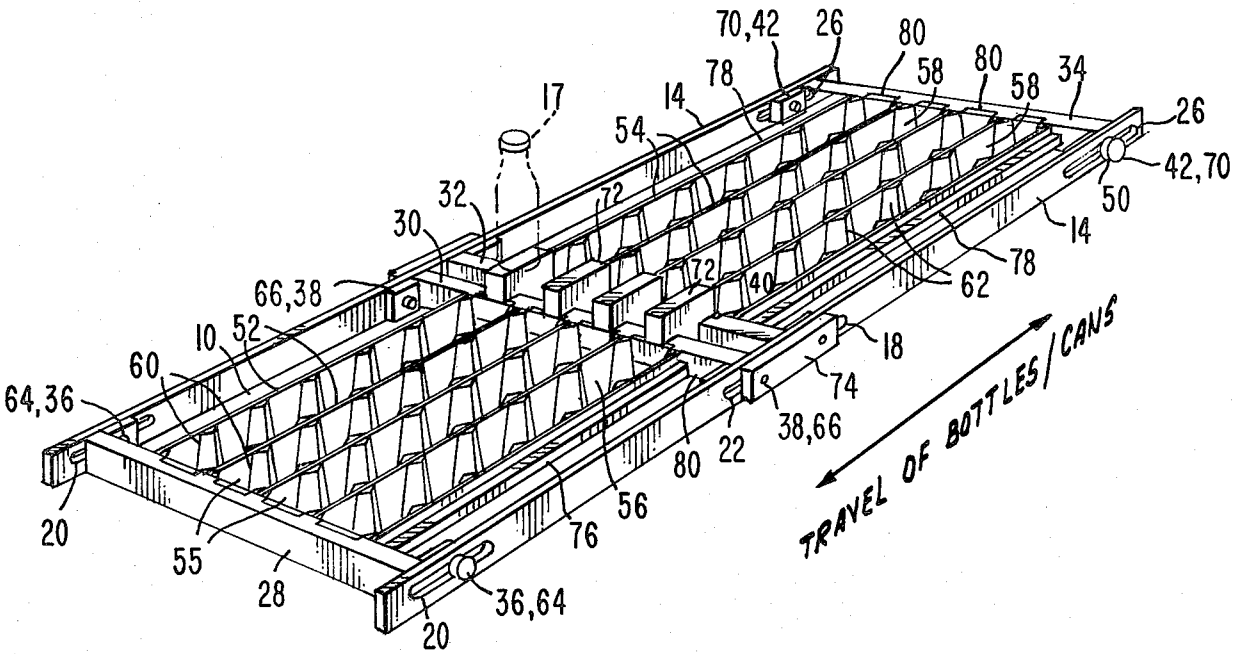
FIG. 1 is a perspective view of an embodiment of the double case loading bottle packer grid assembly of the present invention.
Figure 2:
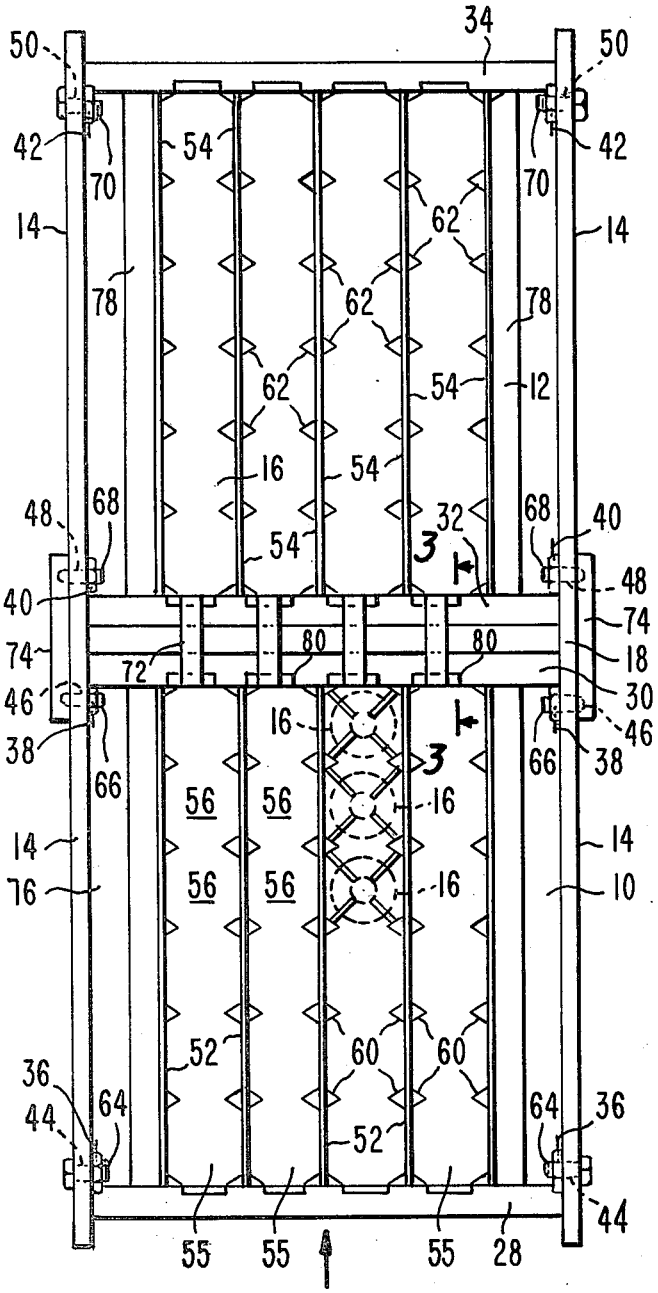
FIG. 2 is a top plan view of an embodiment of a double case loading bottle packer grid assembly of the present invention.

In order to provide this individually removable grid assembly as shown in FIG. 1 a first grid section 10 is removably positioned between longitudinally extending side rail means 14. These side rails 14 extend along the entire length of each case packer grid. A first front transverse member 28 extends laterally from one side rail 14 to the other and is removably secured with respect thereto. Similarly, a first rear transverse member 30 extends between the side rail means 14 in the rear area of the first grid section 10. A plurality of first longitudinal members 52 extend parallel with respect to the side rail means 14 from the first front transverse member 28 to the first rear transverse member 30. In this manner the first grid section 10 is divided into a plurality of bottle receiving rows 55. A plurality of first guide means 60 are fixedly secured with respect to each of the longitudinally extending members 52 in order to divide the bottle receiving rows 55 each into a plurality of first bottle receiving cells 56. In order to maintain structural strength of the first grid section 10 a first longitudinal central area of the side rail means 14. Thus, with this overall configuration it is possible to longitudinally adjust the grid sections 10 and 12 without varying the spacing between the grid sections if such is the desired condition. This spacing between the grids is maintained by usage of the retaining bar 74 in the predetermined distance in order to maintain the dead bottle supporting position. Preferably the dead plate support 72 may be secured with respect to the second grid section 12 and specifically with respect to the second front transverse member 32 to provide the overall structural strength and dead bottle position.

Preferably transverse members 28, 30, 32, and 34 include resiliently flexible inserts therein in order to cushion contact of bottles 16 with respect to the grid itself. In a similar fashion the guide means 60 and 62 preferably expose only resilient surfaces to minimize breakage of bottles 16.

Figure 3:
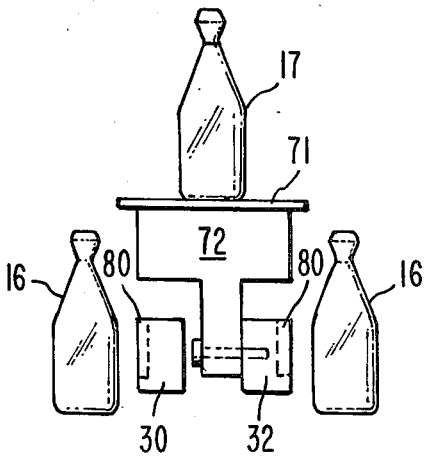
FIG. 3 is a cross-sectional view of FIG. 2 along lines 3—3.
Figure 5:
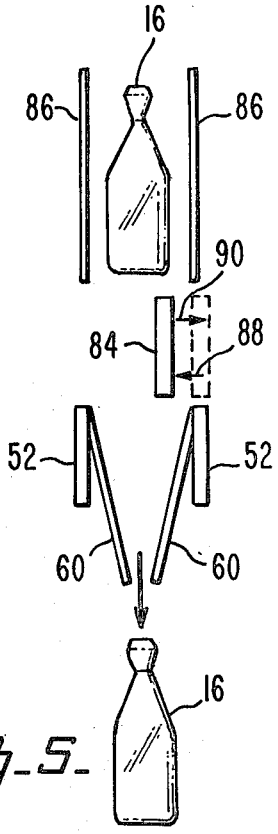
FIG. 5 is a cross-sectional view of FIG. 4 along lines 5—5.
Figure 4:
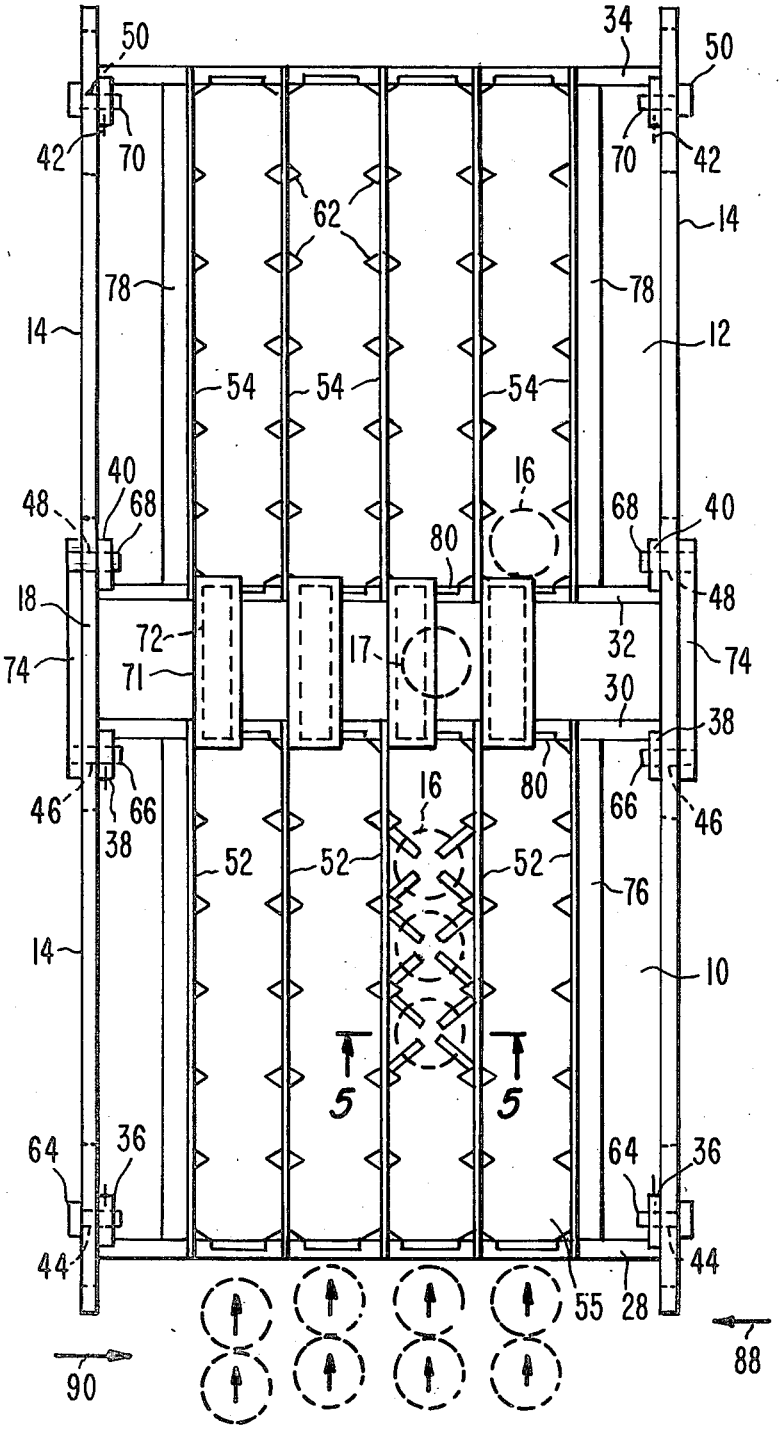
FIG. 4 and 4A represent a top plan view of an embodiment of a double case loading bottle packer grid assembly showing the dividers and bottle support strips and laterally movable members which control release or retainment of bottles in position above the packer.
Figure 4A:
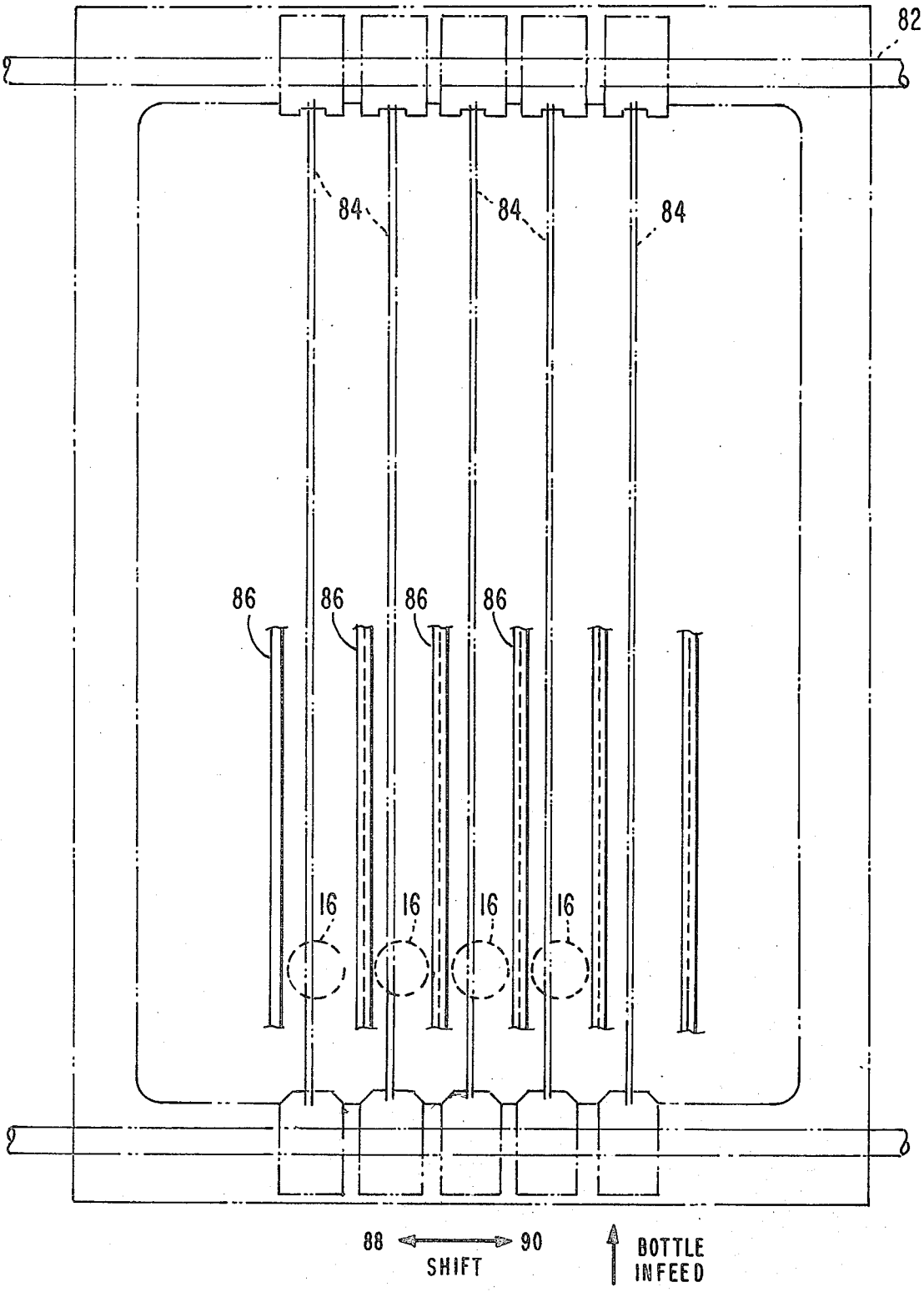

Feeding of the bottles into position above the grid is generally shown by the configuration in FIG. 4. Bottles 16 are urged longitudinally above the grid and are guided into rows by dividers 86. These rows are supported at a position above the grid by the bottle support strips 84 extending below the dividers. As the bottles 16 are fed into the rows between dividers 86 they are supported in position between dividers 86 by the bottle support strips 84 which extend below dividers 86 but are located interposed not in vertical alignment therebetween but below the rows of bottles extending therebetween. With this configuration as best shown in FIGS. 4 and 5 the bottle will be supported thereabove. FIGS. 3 and 5 show the dead plate support 72, but the bottle itself 16 is supported by the member 84. All of the bottle support strips 84 are secured to a lateral movement upper grid frame 82 at the ends thereof. When this upper grid frame 82 is moved completely to the left direction as shown in FIGS. 4, 4A and 5, or in the direction of arrow 88, bottles will be supported. Upon movement to the right as shown by arrow 90 the bottle support strips 84 will become vertically aligned with dividers 86 as shown in the outlined position in FIG. 5 and will allow the bottles to move downwardly through the packing grid at all locations thereabove and be guided into cases located therebelow. The only bottles which will not pass downwardly through the guide means will be those four bottles positioned above the dead plate support 72 and they will be retained in position and will be carried forward into the second grid section when the rows between dividers 86 are again reloaded.

Therefore the configuration of the present design provides a double case grid for packing bottles capable of receiving bottles from any standardly configured control head. Also the present design provides added flexibility since the individual first grid section 10 and second grid section 12 are separately removable from the other surrounding environmental structure merely by removal of the front pin 64, rear pin 70, and the retaining bar 74. Also this removal is in such a manner as to facilitate replacement due to the elongated configurations of the slots defined in the sidewall means 14. This elongated configuration allows replacement at the same or different location if desired and also allows longitudinal movement of the combined grid structure 10 and 12 with respect to the surrounding environmental structure. Also, this flexibility does not endanger the very accurate spacing required in order to maintain the dead bottle area since the front pin of the rear grid section and the rear pin of the front grid section are maintained in a fixed spaced relationship with respect to one another by being held within the retaining bar 74. Therefore the present design provides an added flexibility without endangering a possible variation in spacing which could damage other designs. The overall geometry of the present invention is maintained whereas the longitudinal movement of the entire structure is capable as desired for a particular installation. This added flexibility is a particular aspect of the present invention.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A double case loading bottle and/or can packer grid assembly with individually removable grid sections comprising:

(a) horizontal side rail means extending longitudinally along each side of the path of movement of bottles into the case packer grid assembly and being fixedly secured to the surrounding environmental structure, each of said side rail means defining a first rear slot section and a second front slot section extending laterally therethrough, each of said side rail means further defining a first front slot means extending laterally therethrough positioned upstream of said first rear slot section and said second front slot section and a second rear slot means extending laterally therethrough positioned downstream of said first rear slot section and said second front slot section;

(b) a first grid section positioned between said side rail means adjacent to said first front slot means and said first rear slot section, said first grid section including:

1. a first front transverse member extending laterally between said first front slot means in each of said side rail means, said first front transverse member defining a first front lateral hole means adjacent to each of said first front slot means;
2. a first rear transverse member extending laterally between said first rear slot section in each of said side rail means, said first rear transverse member defining a first rear lateral hole means adjacent to each of said first rear slot sections;
3. a plurality of first longitudinal members extending between said first front transverse member and said first rear transverse member generally parallel with respect to said side rail means to define rows for receiving bottles from thereabove;
4. a plurality of first guide members affixed with respect to each of said first longitudinal members to define a plurality of first bottle receiving cells along each row defined between adjacent longitudinal members;
5. a first front pin means selectively positionable along and extending through said first front slot means into said first front lateral hole means to maintain said first front transverse member in position between said side rail means;

support member 76 is positioned extending along each side thereof between the first front transverse member 28 and the rear transverse member 30. The structural strength added by support member 76 is substantial in order to maintain the integrity and geometry of first grid section 10.

The structure of the grid section 10 is removably detachable with respect to the side rail means 14 by way of a plurality of slots and pins. The first front transverse member 28 defines a first front lateral hole means 44 therein adjacent to the side rail means 14. This first front lateral hole means is registered with and positioned immediately adjacent to a first front slot means 20 defined by the side rail means 14 therein. In this manner the side rail means 14 will define the first front slot means 20 in registration horizontally with the first front lateral hole means 44 defined in the first front transverse member 28. By placement of a first front pin means 64 through first front slot means 20 and first front lateral hole means 44 the first front transverse member 28 will be maintained in position between the side rail 14 and the front portion of the first grid section will be maintained in position and also be easily removable merely by removal of the first front pin means 64. In order to maintain structural strength of the first front lateral hole means 44 preferably that hole means may be located within a strengthened portion of the first front transverse member 28 defined as the first front wedge means 36. This wedge means basically is a stronger laterally dimensioned portion of the first front transverse member 28.

In a similar fashion a first rear transverse member 30 which forms the rear section of the first grid section 10 is positioned between the side rail means 14 downstream from the location of the first front transverse member 28. This rear transverse member 30 will preferably include therein a strengthened portion such as first rear wedge means 38. Within this wedge means will preferably be defined a first rear lateral hole means 46 adjacent to the side rail means 14. Side rail means 14 also defines a first rear slot section 22 therein which is preferably in registration or capable of being in registration with the first rear lateral hole means. When in registration a first rear pin means 66 may be positioned extending through the first rear lateral hole means 46 and the first rear slot section 22 to thereby hold the first rear transverse member 30 in position between the side rail means 14.

In this configuration the first rear transverse member 30 and the first front transverse member 28 will be maintained in position between side rails 14 and the first grid section 10 will thereby be held in position. To remove the first grid section 10 for replacement of parts it will be a simple action merely to remove the first front pin means 64 and the first rear pin means 66 therefrom and thereby not require any removal or disassembly of a substantial nature.

In a similar fashion the second grid section 12 is defined by the foremost lateral member being the second front transverse member 32 and the rearmost lateral member being the second rear transverse member 34. Second front transverse member 32 preferably includes a second front wedge means 40 as an integral or attached part thereof. The second front wedge means 40 may preferably define therein a second front lateral hole means 48. Also, the side rail means 14 thereadjacent will preferably define a second front slot section 24 thereadjacent. Preferably it will be capable to put the second front lateral hole means 48 in registration with the second front slot section 24 and thereby allow for the placement of a second front pin means 68 therethrough to maintain orientation of the second front transverse member 32 in position between side rail means 14.

In the similar fashion the second rear transverse member 34 is capable of positioning between side rails 14 and includes a second rear wedge means 42 therein which defines a second rear lateral hole means 50 of significant structural strength. Adjacent to the second rear transverse member 34 the side rail means 14 defines a second rear slot means 26 which when in registration with the second rear lateral hole means 50 is capable of receiving a second rear pin means 70 therethrough to maintain orientation of the second rear transverse member 34 with respect to the side rail means 14. In this manner the second grid section 12 will be maintained in position downstream from the first grid section 10 between side rails 14. A plurality of second guide means 62 are preferably secured to the second longitudinal members 54 extending from the second front transverse member 32 to the second rear transverse member 34. In this manner the second longitudinal members 54 divide the second grid section 12 into a plurality of bottle receiving rows 55. In this manner the second guide means 62 divides the bottle receiving rows 55 into a plurality of second bottle receiving cells 58.

It is preferable to maintain structural strength of the second grid section 12 and for this purpose a second longitudinal support member 78 may be positioned extending longitudinally down the sides thereof from the second front transverse member 32 to the second rear transverse member 34.

It is preferable when the bottles are being fed into position above the grid of the present invention to include a dead bottle area 17 immediately above the point of interface between the first and second grid sections 10 and 12. In order to provide this dead bottle area a dead plate support 72 may be positionable immediately above the first rear transverse member 30 and a second rear transverse member 32 at each position along each bottle receiving row 55. The dead plate support holds thereabove a dead plate 71. When the bottles are released for movement downward all of the bottles will pass downward through the first guide means 60 and a second guide means 62 into the cases positioned therebelow except those bottles which are located above the dead plate support 72. These four bottles will be retained in position and will be moved upon reloading of the grid into a position in the rearmost area of the second grid section 12.

In order to maintain the configuration of the dead plate area it is necessary to maintain careful dimensional relationships between the first grid section 10 and the second grid section 12. This is made possible by an interlocking of the first rear pin means 66 and the second front pin means 68. This interlocking is achievable by the usage of a retaining bar 74 on each side of the side rail means 14. This retaining bar is adapted to receive fixedly secured therein the first rear pin means 66 and the second front pin means 68. It is necessary to allow adjustment of the first and second grid sections 10 and 12 with respect to the surrounding environmental structure in a longitudinal direction and this is achievable by an elongation of the first front slot means 20, the first rear slot sections 22, the second front slot sections 24, and the second rear slot means 26. Upon elongation of slot sections 22 and 24 it may be necessary to form a central slot 18 which is one continuous open slot in the 6. a first rear pin means selectively positionable along and extending through said first rear slot section into said first rear lateral hole means to maintain said first rear transverse member and said first grid section in position between said side rail means;

(c) a second grid section positioned between said rail means adjacent to said second front slot section and said second rear slot means, said second grid section including:

1. a second front transverse member extending laterally between said second front slot section in each of said side rail means, said second front transverse member defining a second front lateral hole means adjacent to each of said second front slot sections;
2. a second rear transverse member extending laterally between said second rear slot means in each of said side rail means, said second rear transverse member defining a second rear lateral hole means adjacent to each of said second rear slot means;
3. a plurality of second longitudinal members extending between said second front transverse member and said second rear transverse member generally parallel with respect to said side rail means to define rows for receiving bottles from thereabove;
4. a plurality of second guide members fixed with respect to each of said second longitudinal members to define a plurality of second bottle receiving cells along each row defined between adjacent longitudinal members;
5. a second front pin means selectively positionable along and extending through said second front slot section into said second front lateral hole means to maintain said second front transverse member in position between said side rail means;
6. a second rear pin means selectively positionable along and extending through said second rear slot means into said second rear lateral hole means to maintain said second rear transverse member and said second grid section in position between said side rail means; and (d) a dead plate support positioned above said first rear transverse member and said second front transverse member along each of said rows between said first grid section and said second grid section to retain one bottle thereabove in each row during movement of bottles downwardly through said bottle receiving cells.

2. The grid assembly as defined in claim 1 wherein said dead plate support is fixedly secured to said second front transverse member and extends over said first rear transverse member.

3. The grid assembly as defined in claim 1 wherein said first rear slot section and said second front slot section together define a single integral central slot means which is longitudinally elongated to allow for longitudinal adjustment.

4. The grid assembly as defined in claim 1 wherein said first front slot means is longitudinally elongated to allow for longitudinal adjustment.

5. The grid assembly as defined in claim 1 wherein said second rear slot means is longitudinally elongated to allow for longitudinal adjustment.

6. The grid assembly as defined in claim 3 further including a retaining bar extending longitudinally along the outer side of said central slot and being fixedly secured to said first rear pin means and said second front pin means to maintain a predetermined spaced relation therebetween and between said first grid section and said second grid section.

7. The grid assembly as defined in claim 1 wherein said first grid section includes first longitudinal support members fixedly secured to said first front transverse member and said first rear transverse member to fixedly retain orientation of said first grid section.

8. The grid assembly as defined in claim 1 wherein said second grid section includes second longitudinal support members fixedly secured to said second front transverse member and said second rear transverse member to fixedly retain orientation of said second grid section.

9. The grid assembly as defined in claim 1 wherein said first front transverse member includes first front wedge means secured thereto which defines said first front lateral hole means to strengthen retainment of said first grid means.

10. The grid assembly as defined in claim 1 wherein said first rear transverse member includes first rear wedge means secured thereto which defines said first rear lateral hole means to strength retainment of said first grid means.

11. The grid assembly as defined in claim 1 wherein said second front transverse member includes second front wedge means secured thereto which defines said second front lateral hole means to strengthen retainment of said second grid means.

12. The grid assembly as defined in claim 1 wherein said second rear transverse member includes second rear wedge means secured thereto which defines said second rear lateral hole means to strengthen retainment of said second grid means.

13. The grid assembly as defined in claim 1 wherein said first rear transverse member includes resiliently flexible inserts therein adjacent to each row of said bottle receiving cells to minimize bottle damage during downward movement thereof.

14. The grid assembly as defined in claim 1 wherein said second front transverse member includes resiliently flexible inserts therein adjacent to each row of said bottle receiving cells to minimize bottle damage during downward movement thereof.

15. A double case loading bottle and/or can packer grid assembly within individually removable grid sections comprising:

(a) horizontal side rail means extending longitudinally along each side of the path of movement of bottles into the double case packer grid assembly and being fixedly secured to the surrounding environmental structure, each of said side rail means defining a central slot means extending laterally therethrough which includes defined therein a first rear slot section and a second front slot section, said central slot means being longitudinally elongated to allow for longitudinal adjustment of the packer grid, said side rail means further defining a first front slot means extending laterally therethrough positioned upstream of said central slot means and a second rear slot means extending laterally therethrough positioned downstream of said central slot means, said first front slot means and said second rear slot means being longitudinally elongated to allow for longitudinal adjustment of the packer grid with respect to the surrounding environmental structure;

(b) a first grid section positioned between said side rail means adjacent to said first front slot means and said first rear slot section, said first grid section including:

1. a first front transverse member extending laterally between said first front slot means in each of said side rail means, said first front transverse member including a first front wedge means secured thereto which defines a first front lateral hole means adjacent to each of said first front slot means;
2. a first rear transverse member extending laterally between said first rear slot section in each of said side rail means, said first rear transverse member including a first rear wedge means secured thereto which defines a first rear lateral hole means adjacent to each of said first rear slot sections;
3. a plurality of first longitudinal members extending between said first front transverse member and said first rear transverse member generally parallel with respect to said side rail means to define rows for receiving bottles from thereabove;
4. a plurality of first guide members affixed with respect to each of said first longitudinal members to define a plurality of first bottle receiving cells along each row defined between adjacent longitudinal members;
5. a first front pin means selectively positionable along and extending through said first front slot means into said first front lateral hole means to maintain said first front transverse member in position between said side rail means;
6. a first rear pin means selectively positionable extending through said first rear slot section into said first rear lateral hole means to maintain said first rear transverse member and said first grid section in position between said side rail means;
7. a first longitudinal support member fixedly secured to said first front transverse member and said first rear transverse member to fixedly retain orientation thereof and of said first grid section;

(c) a second grid section positioned between said rail means adjacent to said second front slot section and said second rear slot means, said second grid section including:

1. a second front transverse member extending laterally between said second front slot section in each of said side rail means, said second front transverse member including a second front wedge means secured thereto which defines a second front lateral hole means adjacent to each of said second front slot sections;
2. a second rear transverse member extending laterally between said second rear slot means in each of said side rail means, said second rear transverse member including a second rear wedge means secured thereto which defines a second rear lateral hole means adjacent to each of said second rear slot means;
3. a plurality of second longitudinal members extending between said second front transverse member and said second rear transverse member generally parallel with respect to said side rail means to define rows for receiving bottles from thereabove;
4. a plurality of second guide members fixed with respect to each of said second longitudinal members to define a plurality of second bottle receiving cells along each row defined between adjacent longitudinal members;
5. a second front pin means selectively positionable along and extending through said second front slot section into said second front lateral hole means to maintain said second front transverse member in position between said side rail means;
6. a second rear pin means selectively positionable along and extending through said second rear slot means into said second rear lateral hole means to maintain said second rear transverse member and said second grid section in position between said side rail means; and
7. second longitudinal support members fixedly secured to said second front transverse member and said second rear transverse member to fixedly retain orientation of said second grid section (d) a dead plate support fixedly secured to said second front transverse member and positioned above said first rear transverse member and said second front transverse member along each of said rows between said first grid section and said second grid section to retain one bottle thereabove in each row during movement of bottles downwardly through said bottle receiving cells;

and (e) a retaining bar extending longitudinally along the outer side of said central slot means and being fixedly secured to said first rear pin means and said second front pin means to maintain a predetermined spaced relation therebetween and between said first grid section and said second grid section.

* * * * *